United States Patent [19]

Lahti et al.

[11] 4,341,982

[45] Jul. 27, 1982

[54] SIMULTANEOUS INDEPENDENT CONTROL SYSTEM FOR ELECTRIC MOTORS

[75] Inventors: Abbott W. Lahti, Cambridge; Stephen R. Russell, Acton, both of Mass.

[73] Assignee: Power Systems, Inc., Cambridge, Mass.

[21] Appl. No.: 165,413

[22] Filed: Jul. 3, 1980

[51] Int. Cl.[3] ..... H02P 7/68

[52] U.S. Cl. ..... 318/51; 318/67; 318/87; 318/91; 318/107; 318/108; 318/109; 318/110; 104/300; 104/301; 10/302

[58] Field of Search ..... 318/107, 108, 109, 110, 318/51, 67, 86, 87, 91; 307/2, 3, 4; 104/297, 300, 301, 302; 340/310 R, 310 A

[56] References Cited

U.S. PATENT DOCUMENTS 3,211,111 10/1965 Morley ..... 104/301

3,315,613 4/1967 Leslie ..... 104/301

3,909,618 9/1975 Fujii et al. ..... 307/3

4,290,000 9/1981 Sun ..... 318/434

*Primary Examiner*—J. V. Truhe

*Assistant Examiner*—Eugene S. Indyk

*Attorney, Agent, or Firm*—Morse, Altman, Oates & Dacey

[57] ABSTRACT

A system for simultaneously and independently controlling a plurality of electric motors from a number of dispersed stations. The system operates by transmission of duty cycle modulated selected frequencies superimposed on a DC track voltage on a common power line servicing the motors. The modulation is variable and determines the speed of the motors. Transmitters are portable and designed removably to plug into a common signal transmission cable anywhere along its length without interaction. Receivers, each tuned to a specific frequency and associated with and controlling a motor, are coupled to the common power line.

15 Claims, 4 Drawing Figures

SIMULTANEOUS INDEPENDENT CONTROL SYSTEM FOR ELECTRIC MOTORS

BACKGROUND OF THE INVENTION

1. Field of the Invention

The present invention relates generally to systems for controlling the operation of motors and, more particularly, to a system for simultaneously and independently controlling a plurality of electric motors from a number of dispersed stations without interaction.

2. The Prior Art

In the operation of model railroads, a need exists to control a number of model railroad locomotives running on a common track. The control for each of the locomotives is to be reliable, simultaneous and independent as between locomotives. One such known system powers the common track by a low voltage 60 Hz AC power. Each locomotive motor is controlled by a receiver tuned to a particular frequency which modulates the low voltage 60 Hz AC propulsion power. Forward motor rotation is effected by detecting the modulation on one half cycle of the low voltage 60 Hz AC power and reverse motor rotation is effected by detecting the modulation on the other half cycle. Full speed for the motors can, of course, only be had from the respective one half wave rectified 60 Hz AC power. In addition to the resultant noisy operation, this system incorporates a flaw in that if the applied low voltage 60 Hz AC power is phase shifted 180°, then all motors on the track powered from that 60 Hz AC will start running in reverse. Also, due to the use of AC power for propulsion, the control signals are easily shorted or swamped by resistive loading, such as by light bulbs in cars or locomotives.

Another known system employs low voltage DC power to power the common track and the receivers and to provide the propulsion power to the locomotive motors. A pulse train is used to modulate the low voltage DC power. The spacing between successive pulses, i.e., pulse position modulation, represents the control to a specific motor. The system uses circuitry that is complex, somewhat cumbersome, hence expensive.

SUMMARY OF THE INVENTION

It is a principal object of the present invention to overcome the above disadvantages by providing a system for the simultaneous and independent control of a plurality of motors from a number of dispersed and relocable stations. The system is characterized by an operation that is reliable, free of interaction between motors and is relatively simple.

More specifically, it is an object of the present invention to provide a system for simultaneously and independently controlling a plurality of electric motors from a number of dispersed and relocable stations comprising a common power line servicing a plurality of motors. A power supply unit generates propulsion power for the motors and supplies it to the common power line. A plurality of actuators generate a plurality of variably modulated selected frequencies and superimpose these frequencies via the power supply unit onto the propulsion power on the common power line. The actuators are portable and designed removably to plug into a common signal transmission cable anywhere along its length without interaction between the actuators. A plurality of receivers is coupled to the common power line, with each receiver tuned to a selected modulated frequency and associated with and controlling one of the motors. Each of the plurality of actuators features a replaceable, interchangeable frequency selector matched to a predetermined frequency of a specific receiver. The variable modulation of the selected frequencies is duty cycle modulation and the modulation determines the speed of the motors.

Other objects of the present invention will in part be obvious and will in part appear hereinafter.

The invention accordingly comprises the system of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
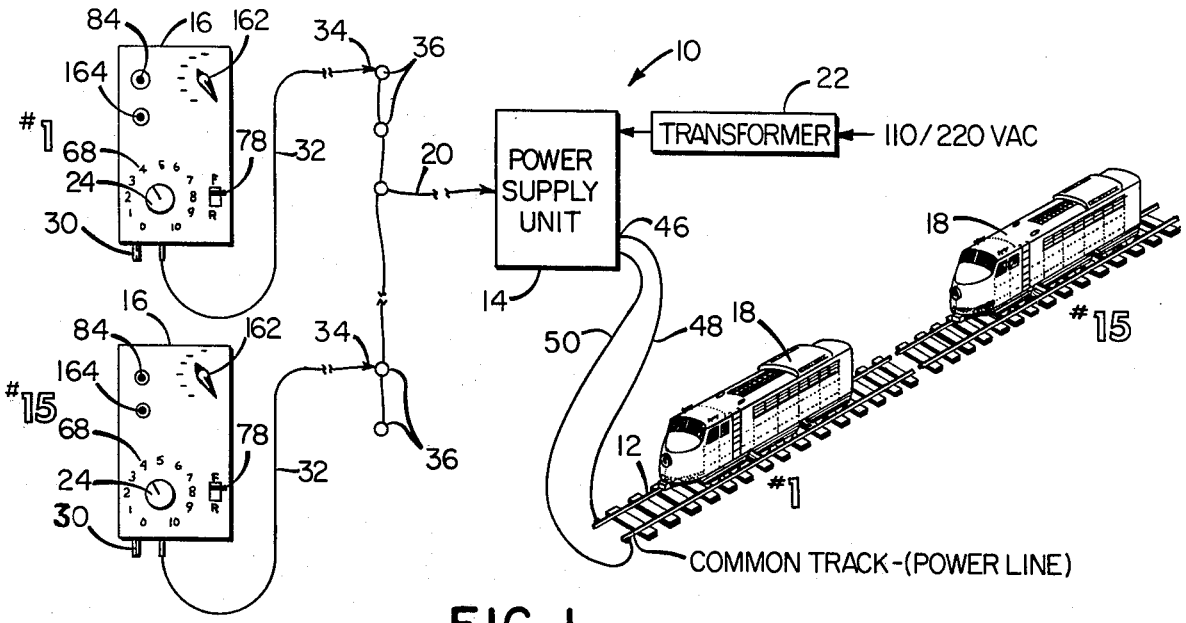
FIG. 1 is a general schematic, partially in perspective, of a system constructed in accordance with and embodying the present invention.

Generally, the illustrated embodiment of a system 10 for the simultaneous and independent control of a plurality of motors from a number of dispersed and relocable stations comprises a common power line or common track 12, a power supply unit 14 to power the line 12, a plurality of portable actuators or transmitters 16 for generating modulated selected frequencies and for superimposing these frequencies via the power supply unit 14 onto the power on the line 12, and a plurality of receivers 18 coupled to the common power line 12. The actuators 16 are designed removably to plug into a common signal transmission cable 20 anywhere along its length without interaction between the actuators 16.

The system 10 is designed as a control system for electric motors in general, in which the motors are both powered and controlled from the common power line 12. The illustrated embodiment depicts a model railroad, it being understood that the system 10 is equally applicable to the control of motors employed in other like settings or circumstances. The propulsion power for the motors is preferably low voltage DC power, such as +10 to +15 VDC. The preferred frequency range for the selected frequencies is about 10 KHz to about 400 KHz; the preferred length for the common signal transmission cable 20 is about 200 feet; and the preferred number of electric motors controlled by the system 10 is anywhere up to fifteen motors. The selected frequencies are preferably duty cycle modulated. Duty cycle as used herein defines the ratio of working time to total time for an intermittently operating device and is expressed as a percent. Each actuator 16 is portable, can generate any one of the selected frequencies, and can vary duty cycle modulation of each of the particular selected frequency anywhere from 0% modulation to 100% modulation. Each of the receivers 18 is tuned to one specific selected frequency, with the receivers 18 interpreting 0% modulation as "off," 25% modulation as one quarter speed, 50% modulation as one half speed, 75% modulation as three-quarters speed, and 100% modulation as full speed. The direction of motor rotation is not dependent on the polarity of the common track 12. In a preferred embodiment and as herein illustrated and more fully described, reversing of a motor is accomplished by using a second, slightly offsetted transmission frequency, with each of the receivers 18 having a second parallel receiving channel to detect operation in the reverse. In another preferred embodiment, not otherwise illustrated herein, a single transmitted frequency is used but the repetition rate of the duty cycle modulation is changed to reverse the motor.

The power supply unit 14 represents the main power supply for the system 10. Power supply unit 14 is powered by a step-down transformer 22 that is plugged into a conventional 110/220 VAC power source and transforms the 110/220 VAC preferably to 18 VAC going to the power supply unit 14. The power supply unit 14, in turn, in addition to supplying the low voltage DC propulsion power for the motors to the common track or power line 12, also powers the actuators 16 via the common signal transmission cable 20, which is a three-wire cable. The preferred power supplied to the actuators 16 by the power supply unit 14 is in the range of 18 VDC and 24 VDC.

Figure 2:
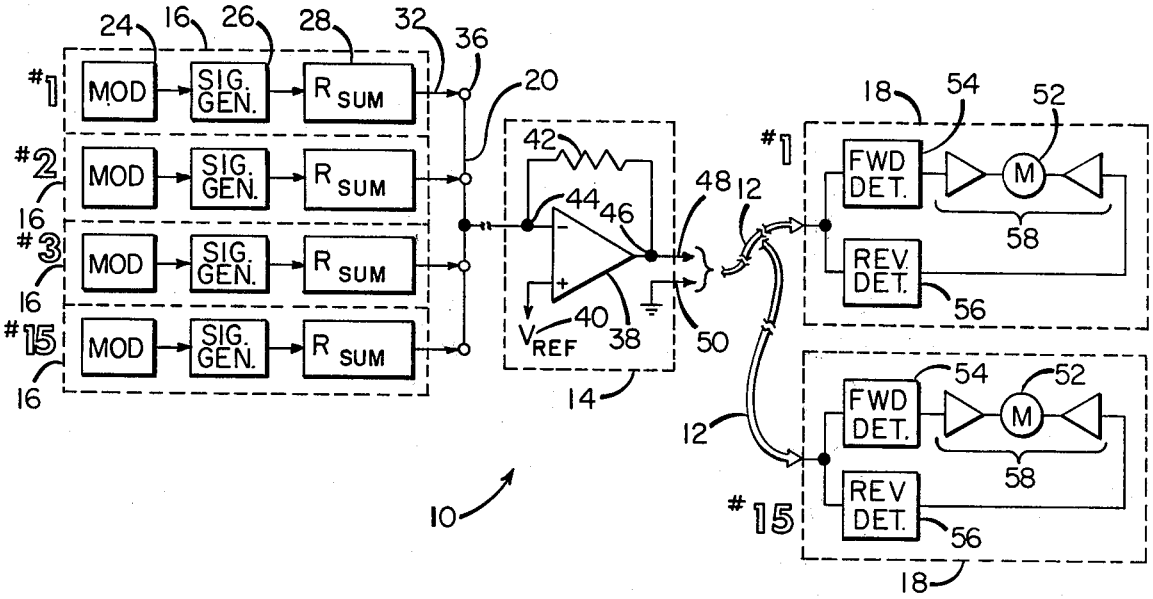
FIG. 2 is a block diagram of the system of FIG. 1.

Referring to FIGS. 1 and 2, each portable transmitter or actuator 16 includes a variable duty cycle modulator 24, a carrier control signal generator 26 controlled by the variable duty cycle modulator 24 and a brake system more fully described below, a summing resistor 28, and a replaceable, interchangeable frequency selector 30. The frequency selector 30 is in the nature of a plug and comprises a precision resistor. The particular selected frequency of the carrier control signal generated by the generator 26 is determined by the frequency selector 30.

Each portable transmitter or actuator 16 is provided with a connecting cable 32, also a three-wire cable, of suitable length, with the preferred length being about ten feet. A three-pin connector 34 at the free end of the cable 32 is designed to plug into any one of a plurality of sockets 36. The sockets 36 are wired in parallel and are arranged at spaced intervals along the length of the common signal transmission cable 20.

The power supply unit 14 essentially comprises a wide bandwidth, feedback regulated amplifier/power supply 38. The bandwidth of this amplifier/power supply 38 is as wide as the highest selected carrier control signal frequency employed in the system 10. A reference voltage VREF 40 connects to the positive non-inverting input of the amplifier/power supply 38 whose output is fed back across a resistor 42, representing a resistive divider, to the negative inverting or summing input 44. The summing input 44 is also the control for a power section of the regulated DC power supply supplied by the unit 14 to the track 12. It is at this summing input 44 of the amplifier/power supply 38 where all of the modulated carrier control signals are introduced from each of the actuators 16 plugged into one of the sockets 36 on the common signal transmission cable 20. This inverting input 44 of the amplifier/power supply 38 is at a virtual ground. Consequently, the actuators 16 can be located close by or remote from the power supply unit 14, and only the actual length of the common signal transmission cable 20 sets the limit of the widest distance separating one actuator 16 from the power supply unit 14. Furthermore, it is because the inverting input 44 of the amplifier/power supply 38 is at a virtual ground that the system 10 requires only one common signal transmission cable 20 into which all of the actuators 16 can be plugged in without interaction among the several modulated selected carrier control frequencies generated by the several plugged in actuators 16. As mentioned, the actuators 16 superimpose these several modulated selected carrier control frequencies via the power supply unit 14 onto the low voltage DC propulsion power supplied to the common power line or track 12. These several modulated carrier control frequencies superimposed on the DC propulsion power voltage appearing at the output 46 of the power supply unit 14 are at very low impedance levels. As a consequence, these modulated carrier control frequencies, coupled to the common power line or track 12 by leads 48 and 50, are little if at all affected by capacitive and/or resistive loading across the common power line 12. The signal level of the modulated carrier control frequencies at the output 46 of the power supply unit 14 is determined for the most part by the ratio of the assigned value of the feedback resistor 42 over the assigned value of the summing resistor 28 irrespective of how many of the actuators 16 are plugged into the common signal transmission cable 20.

A plurality of receivers 18 is coupled to the common power line or track 12. Each of these receivers 18 is tuned to a specific carrier control signal frequency or channel, and is associated with and controls one of the electric motors 52. Each receiver 18 includes a forward detector 54 and a reverse detector 56. The detectors 54 and 56 are phase-locked loop detectors that permit accurate and frequency defined detection of signals within electrically noisy environments. The reverse detector 56 is tuned to frequency "f" and the forward detector 54 is tuned to frequency "$f-\Delta f$." Thus, change in the rotational direction of the motors 52 is accomplished by offsetting the primary frequency "f" a small percentage, i.e., by effecting a frequency shift. The detectors 54 and 56 control a full wave "H" bridge 58 that drives the motors 52 and isolates motor sparks from the common power line or track 12.

Whenever either carrier control frequency signal "f" or "$f-\Delta f$" is present on the common power line 12, the respective detector 54 or 56 is actuated, which in turn actuates one half of the "H" bridge 58, causing the DC motor 52 connected between the bridge 58 to operate. When the other carrier control frequency signal is received by the receiver 18, the other of the detectors 54 and 56 is actuated, rendering the other half of the bridge 58 conductive, causing thereby the DC motor 52 to rotate in the other direction. The rotational speed of the motors 52 is proportional to the duty cycle modulation of the selected carrier control frequency signal.

Figure 3:
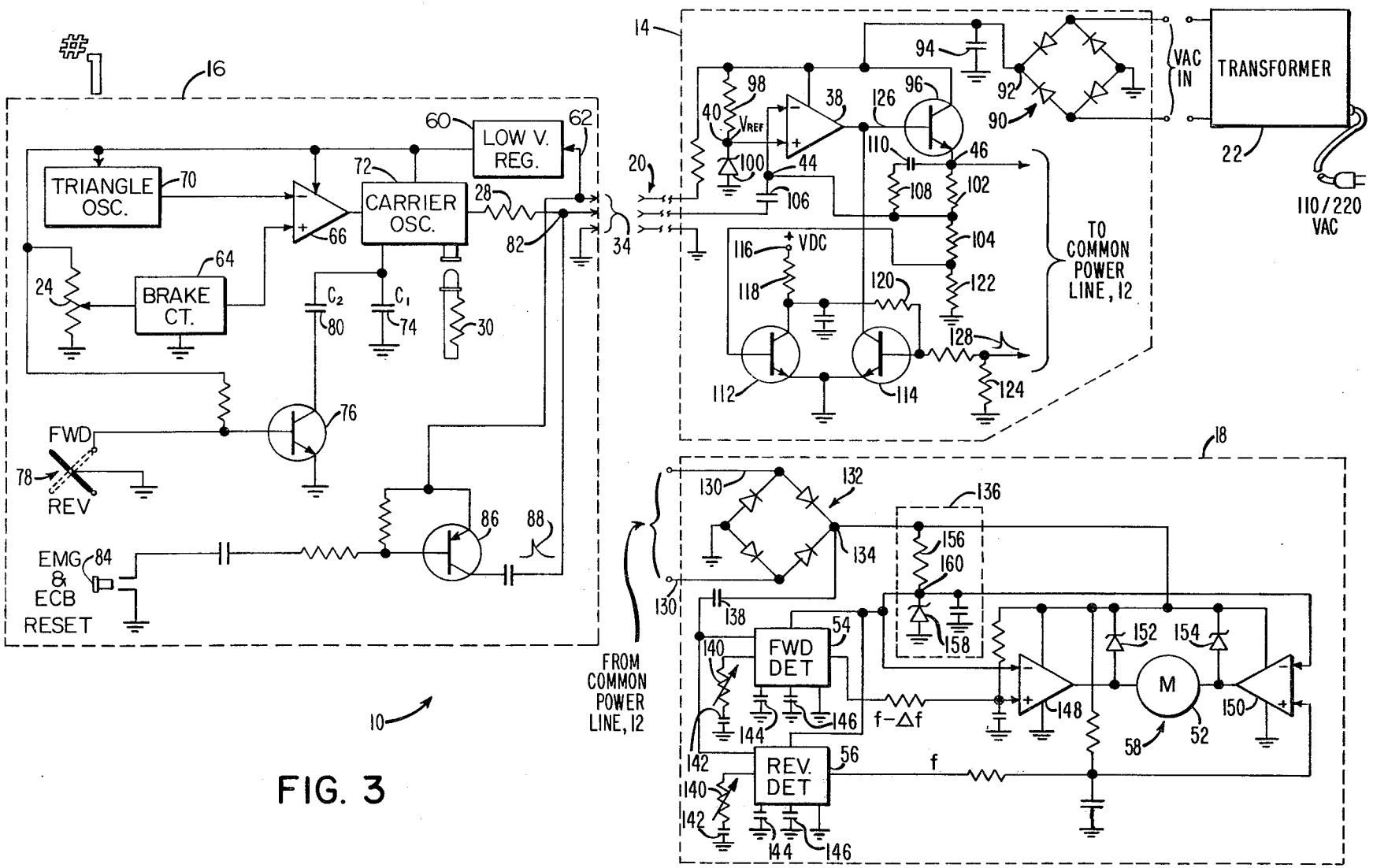
FIG. 3 is an electrical schematic of the system of FIG. 1.
Figure 4:
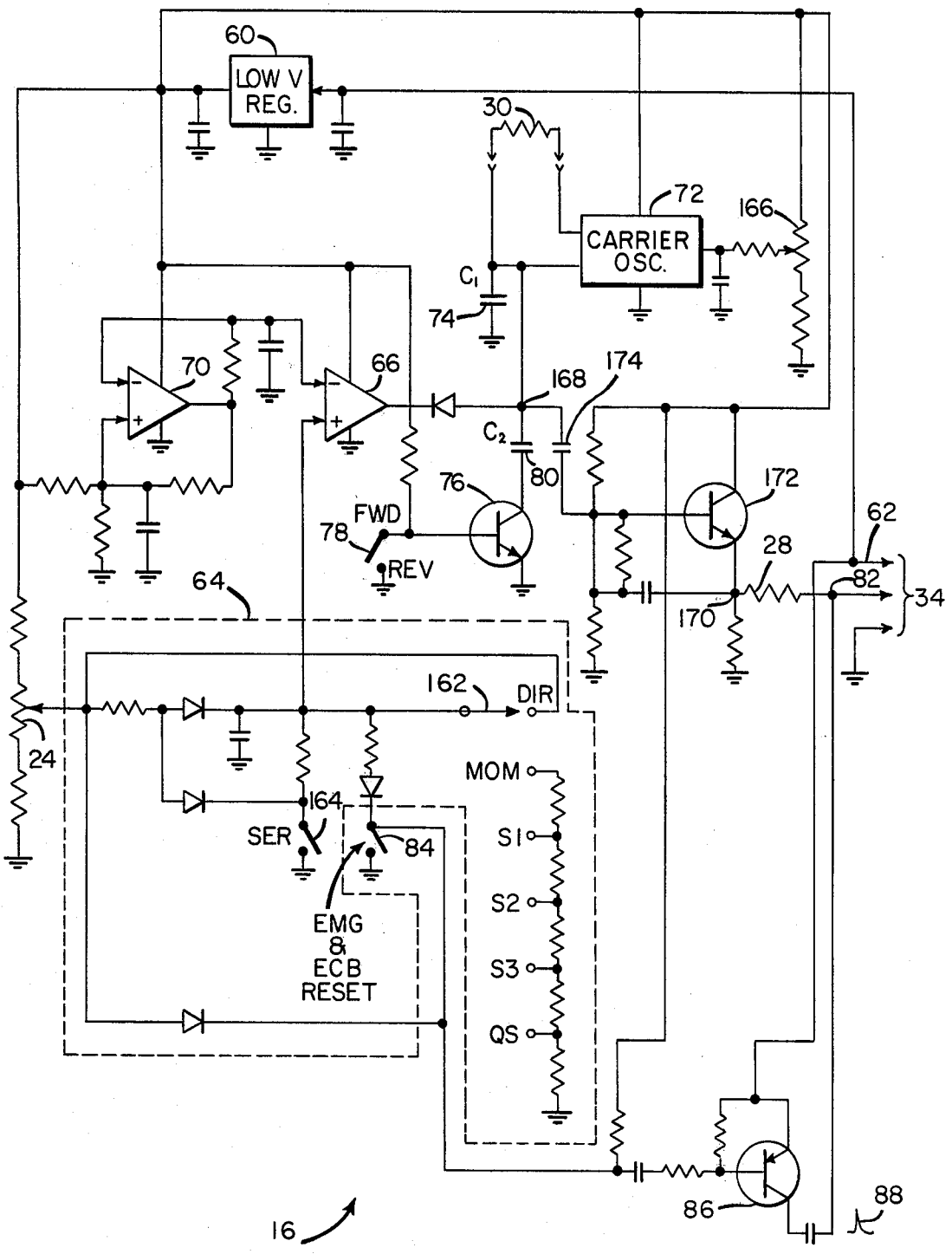
FIG. 4 is a more detailed electrical schematic view of one component part of the system of FIG. 1.

An electrical schematic of the system 10 is disclosed in FIG. 3, and a more detailed schematic of one component part, that of the actuator 16, is depicted in FIG. 4. The modulator 24 is a variable potentiometer having a low voltage (about 5 volts) DC power supply supplied to it by a low voltage regulator 60. The low voltage regulator 60 is in turn powered by a high voltage (about 20 volts) DC power via one wire 62 of the three-wire common signal transmission cable 20 connecting the actuators 16 with the power supply unit 14. The variable modulator 24 provides a proportional DC control voltage, via a brake circuit 64, to the positive input of a comparator 66. The value of the proportional DC control voltage is of course determined by the setting of the modulator 24 with respect to a circular scale 68 (note FIG. 1) conveniently marked from zero to ten at the face of each of the actuators 16. A triangle oscillator 70 is provided to feed the negative input of the comparator 66. With no DC control voltage provided by the modulator 24, i.e., with the modulator 24 set at zero on the scale 68, the output of the comparator 66 is low. With maximum DC control voltage, i.e., with the modulator 24 set at ten on the scale 68, the output of the comparator 66 is high. For in between settings on the scale 68, i.e., from one to nine, the comparator 66 output is duty cycle modulated, that is, pulse width modulated. The duty cycle modulated output from the comparator 66 actuates a carrier oscillator 74 which generates a duty cycle modulated carrier control signal at a frequency "f" selected by the frequency selector 30 and capacitor 74, $C_1$, when NPN transistor 76 is biased "off," i.e., is non-conducting. The NPN transistor 76 is biased off by having its base grounded by a toggle switch 78 shown in a phantom position, representing the reverse (Rev) position. In the forward (Fwd) position of the toggle switch 78, shown in solid lines, the base of the NPN transistor 76 is ungrounded, causing it to conduct in a saturated condition. The conducting NPN transistor 76 clamps capacitor 80, $C_2$, to ground. As a consequence, the frequency selector 30 now tunes with both capacitor 74, $C_1$, and capacitor 80, $C_2$, to offset the reverse frequency "f" a small percentage, i.e., "$f-\Delta f$." Thus, the duty cycle modulated carrier control signal generated by the carrier oscillator 72 is frequency shifted to a forward (Fwd) frequency, "$f-\Delta f$," the significance of which will be more fully evident below. In either position of the toggle switch 78, the duty cycle modulated carrier control signal, at the selected forward or reverse frequency as essentially determined by the replaceable frequency selector 30, is passed through the summing resistor 28 to the output 82 of the actuator 16. As will be observed, output 82 is connected to the second pin of the three-pin connector 34 and thereby to the three-wire common signal transmission cable 20. As will be further observed, the triangle oscillator 70, the comparator 66, and the carrier oscillator are each powered by the low voltage DC power from the low voltage regulator 60, which also provides the bias voltage to the base of the NPN transistor 76.

Each actuator 16 is, furthermore, provided with an emergency and electronic circuit breaker reset (EMG and ECB RESET) button 84 and its associated circuitry. This associated circuitry includes a normally non-conducting PNP transistor 86 whose emitter and base are connected to the high voltage DC power supply supplied to the actuator 16 via the wire 62 of the common signal transmission cable 20. Depressing the button 84 momentarily grounds the base of the PNP transistor 86, producing a positive pulse 88 at the output 82 of the actuator. The significance of this positive pulse 88 will be more fully described below.

As already mentioned, the power supply unit 14 is the main power supply for the system 10. The step-down transformer 22 feeds the unit 14 with low voltage $VAC_{IN}$ (about 18 VAC) via a full wave rectifier 90. In the alternative, the power input to the unit 14 can be a filtered and regulated DC power supply between about 18 VDC and 24 VDC, not shown, and connected at point 92, representing the output of the rectifier 90. Preferably, a 24 VDC to 25 VDC appears at point 92, maintains fully charged a capacitor 94 and also powers the wide bandwidth, feedback regulated amplifier/-power supply 38, and NPN pass transistor 96, and each of the actuators 16 that may be plugged into the common signal transmission cable 20. In addition, the DC voltage at point 92 also establishes the reference voltage (VREF) 40 to the control PLUS input of the amplifier/-power supply 38 across a resistor 98, to which a Zener diode 100 is parallel connected. The DC output level of the power supply unit 14 at its output 46 is, in turn, established by this reference voltage (VREF) 40 and the ratio of the assigned values of resistors 102 and 104 over the assigned value of the resistor 104. The carrier control signal level, as mentioned, is very close to the ratio of the assigned value of the resistor 102 over the assigned value of the summing resistor 28 of the actuators 16, and remains constant regardless how many actuators 16 (up to a preferred fifteen) are connected to the power supply unit 14. As will be noted in FIG. 3, the output of the amplifier/power supply 38 (an operational amplifier) via the pass transistor 96, is fed back across the resistor 102 to the summing, inverting input 44 of the amplifier/power supply 38. As also mentioned, it is to the summing, inverting input 44 that all modulated carrier control frequencies from each of the plugged in actuators 16 are fed across a capacitor 106. Furthermore, a carrier gain set resistor 108 is AC coupled via a capacitor 110 in parallel with the resistor 102 between the summing, inverting input 44 and the output 46 of the power supply unit 14. This arrangement allows several power supply units 14 to be connected in parallel to the common signal transmission cable 20 so that each of the units 14 will have the same modulated carrier control signal frequencies but will feed different sections of the common power line or track 12.

There are two basic reasons why multiple power supply units 14, fed by the same modulated carrier control signal frequencies over the one common signal transmission cable 20, may be desirable. The first reason is where the load exceeds or strains the capability of one power supply unit 14, and the second is a system in which one area of the layout is better off isolated from an adjacent area. In the latter case of isolation between adjacent areas, a short circuit occurring in one area will not interrupt the functioning of the motors 52 connected in another area.

Each power supply unit 14, furthermore, includes a latch transistor 112 and a limiter transistor 114, both NPN transistors, connected in a common-emitter configuration to ground. The normally "on" latch transistor 112 and the normally "off" limiter transistor 114 comprise the electronic circuit breaker (ECB) of the power supply unit 14, representing an important safety feature of the system 10. The ECB operates rapidly (within about 2 milliseconds) to remove output DC propulsion power from the output 46 of the power supply unit 14 feeding the common power line or track 12 any time a short circuit occurs or there is a reduction in the DC output voltage caused by excessive loading.

The latch transistor 112 is powered by a low voltage DC power 116 (preferably about +5 VDC) coupled to its collector via a resistor 118. The junction of the resistor 118 and the latch transistor's collector is, in turn, connected via a resistor 120 to the base of the limiter transistor 114. The base of the latch transistor 112 is connected to the junction of the resistor 104 and a resistor 122 whose other end is grounded. A current sampling resistor 124 is parallel connected between the base of the limiter transistor 114 and ground. The collector of the limiter transistor 114 is connected to a lead 126 coupling the output of the amplifier/power supply 38 directly to the base of the pass transistor 96.

Whenever the load current flowing in the common power line 12 is excessive as sampled through the current sampling resistor 124, a resultant positive pulse voltage 128 is applied to the base of the normally "off" limiter transistor 114, turning the transistor 114 on. Conduction through the limiter transistor 114 causes the base of the pass transistor 96 to be pulled to ground, effectively and swiftly shutting off all further conduction through the pass transistor 96. This of course results in immediately removing all further DC propulsion power from the common power line or track 12. The sudden ceasing of conduction through the pass transistor 96 also causes the base of the normally "on" latch transistor 112 to be pulled to ground and thus turn the transistor 112 off. As a result, the collector of the transistor 112 goes positive, which is coupled to the base of the limiter transistor 114, so as to latch the limiter transistor 114 in its conducting state even after the overload condition has been removed from the common power line 12. The ECB can be reset only by depressing the EMG and ECB RESET button 84 on any actuator 16 that is connected via the common signal transmission cable 20 to that particular power supply unit 14, that is if there happen to be multiple units 14 used in the system 10.

When the ECB RESET button 84 is depressed, it momentarily grounds the base of PNP transistor 86, producing thereby the positive pulse 88 at the output 82 of the actuator 16. This positive pulse 88 is then transmitted via the summing input 44 and the resistor 104 to the base of the latch transistor 112, turning transistor 112 once again on. The conduction through latch transistor 112 pulls its collector to ground, which in turn grounds the base of the limiter transistor 114, turning transistor 114 once again off. The non-conduction through limiter transistor 114 releases the base of the pass transistor 96 from ground, thus rendering it conductive again. As a result, the common power line 12 is again supplied with DC propulsion power on which it has been superimposed the several modulated selected carrier control frequencies generated by the several actuators 16 plugged into the common signal transmission cable 20.

As already mentioned, the receivers 18 are coupled to the common power line or track 12. The coupling is either through the wheels, in the case of the model locomotives illustrated in FIG. 1, or is effected by a tether or the like. This coupling is represented by leads 130 in FIG. 3. Leads 130 feed the modulated carrier control signal frequencies superimposed on the DC propulsion power from the common power line 12 to a full wave rectifier bridge 132. The function of this bridge 132 is to free the receiver 18 from a particular polarity dependence affecting the rotational direction of its associated motor 52. The output 134 of the rectifier bridge 132 is parallel coupled to a low voltage regulator 136 and AC coupled via a capacitor 138 to both the forward and reverse detectors 54 and 56. As mentioned, these detectors 54 and 56 are phase locked loop detectors tuned to the specific forward and reverse frequencies of a particular channel as determined by the specific replaceable frequency selector 30. The tuning is accomplished through variable resistors 140 and capacitors 142. In addition, each of the detectors is provided with loop and output filters 144 and 146, respectively.

Whenever either the specific forward frequency ($f-\Delta f$) or the specific reverse frequency (f) to which the detectors 54 and 56 are tuned, is present, the respective detector 54 or 56 turns on. The respective detector 54 or 56 in turn actuates one half of the full wave bridge 58. Bridge 58 comprises a pair of power operational amplifiers (op amp) 148 and 150 used as comparators, and representing the two halves of the bridge 58. The respective actuated power op amp 148 or 150 then causes the DC motor 52 connected between the bridge 58 to operate, either in forward or in reverse.

Preferably, the DC propulsion power supplied to the common power line or track 12 by the power supply unit 14 is about 14 VDC. At the output 134 of the rectifier bridge 132, this voltage drops a bit to about 12 VDC, which voltage powers the power op amps 148 and 150 and the motor 52 via these power op amps 148 and 150. The low voltage regulator 136, which essentially comprises a resistor 156 and a Zener diode 158, drops this voltage down to about 5 VDC at their junction 160. From this junction 160, the low voltage regulator 136 powers the detectors 54 and 56 and also provides the bias at the negative inputs of the power op amps 148 and 150. As already fully explained above, the rotational speed of the motor 52 is proportional to the percent modulation, effected by the variable modulator 24 (the throttle), of the carrier control signal.

A more detailed electrical schematic view of the actuator or transmitter 16 is depicted in FIG. 4. There are two kinds of actuators 16 in the system 10: a direct function actuator 16 as shown in both FIGS. 3 and 4 but without the brake circuit 64, and a full function actuator 16 with the brake circuit 64. In the direct function actuator 16, the variable modulator 24 is connected directly to the positive input of the comparator 66. Motors 52 actuated from direct function actuators 16 respond instantaneously and their rotational velocity is proportional to the position of the variable modulator 24 with respect to the circular scale 68. The motors 52 progressively reduce their speed as the modulator 24 is turned counterclockwise and lower against this scale 68, and the motors 52 will halt when the modulator 24 points to zero at the scale 68. When a sudden cessation of the operation of the motors 52 is desired, the same is accomplished by depressing the EMG (ergency) ECB RESET button 84, which also grounds the positive input of the comparator 66, a connection omitted for the sake of clarity of FIG. 3.

The full function actuator 16, i.e., one with the brake circuit 64 in place, can also be made to work in a direct mode (DIR), just like a direct function actuator, by a selector handle 162, observe both FIGS. 1 and 4. There are five additional operative positions for the selector handle 162, respectively marked: MOM S1, S2, SR and QS. With the selector handle 162 in the MOM (entum) position, and the variable modulator 24 at three or four on the circular scale 68, the respective actuated motor 52 will begin to move slowly from a dead stop, followed by accelerating realistically, in case of a model train, much like a real one. There are two ways to slow down the motor 52 run in the MOM position. The first is by using a switching brake 164, also marked SER, which also grounds the positive input to the comparator 66, regardless of the position of the variable modulator 24. The second is by using the rotary main line brake as represented by the four braking rates of S1, S2, S3 and QS. These four braking rates of S1, S2, S3 and QS (quick service) can be progressively selected by turning the selector handle 162 and they work progressively and directly against the position of the variable modulator 24 (the throttle). Thus, an operator can select a great many deceleration rates depending on the modulator 24 position combined with the selector handle 162 position. In order to achieve a dead stop, the modulator 24 must be turned to zero setting on the circular scale 68. The quickest way to stop the motor 52, however, when the selector handle 162 is in the MOM position is to move the handle 162 into the DIR (ect) position and press the EMG & ECB RESET button 84 or turn the variable modulator 24 to the zero setting along the scale 68.

The more detailed schematic of the actuator 16 depicted in FIG. 4 also discloses a fine tune potentiometer 166 for calibrating the carrier oscillator 72 and a buffer arrangement connected between the junction 168 of the outputs of the comparator 66 and the carrier oscillator 72 and the inboard side 170 of the summing resistor 28. This buffer arrangement essentially comprises and NPN transistor 172, powered by the low voltage regulator 60, with its base connected via a capacitor 174 to the junction 168 and its emitter coupled to the inboard side 170 of the summing resistor 28.

We have thus shown and described a system 10 for simultaneously and independently controlling a plurality of electric motors 52 from a number of dispersed stations,, which system 10 satisfied the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A system for simultaneously and independently controlling a plurality of motors comprising:

(a) A common power line;

(b) a plurality of motors connected to said power line;

(c) a power supply unit comprising a wide bandwidth feedback regulated amplifier and power supply for generating low voltage propulsion power for said motors to said power line;

(d) a common signal transmission cable coupled to the negative inverting input of said wide bandwidth feedback regulated amplifier and power supply;

(e) a plurality of means for generating a plurality of modulated selected frequencies and for superimposing said frequencies via said power supply unit on said low voltage propulsion power, each of said means being portable and being removably parallel coupled to said common signal transmission cable;

(f) a plurality of replaceable and interchangeable frequency selectors, one each for each one of said plurality of means for generating said plurality of modulated selected frequencies, for determining each of said selected frequencies; and (g) a plurality of receivers coupled to said common power line, each of said receivers tuned to one of said modulated selected frequencies and associated with and controlling one of said motors.

2. The system of claim 1 wherein said common power line is a track for a model railroad.

3. The system of claim 1 wherein said motors are electric motors.

4. The system of claim 1 wherein said wide bandwidth feedback regulated amplifier and power supply is an operational amplifier having a reference voltage connected to its positive, non-inverting input and whose output is fed back across a resistive divider to its said negative inverting input.

5. The system of claim 1 wherein each of said plurality of means for generating a plurality of modulated selected frequencies includes a carrier signal generator for generating a carrier signal, a variable duty cycle modulator for modulating said carrier signal, and a plurality of progressively variable and individually selectable braking resistances working in opposition to and progressively against the position of said variable duty cycle modulator, whereby a multiplicity of deceleration rates for said motors is achievable.

6. The system of claim 5 wherein each of said pluraity of replaceable and interchangeable frequency selectors is a replaceable precision resistor, and said variable duty cycle modulator is a variable potentiometer that controls the speed of its said associated motor.

7. The system of claim 1 further characterized in that some of said plurality of means for generating said plurality of modulated selected frequencies are disposed remote from said power supply unit.

8. The system of claim 1 further characterized in that each of said receivers includes a pair of detectors, with each of said pair of detectors being a phase-locked loop detector, wherein one of said pair of detectors is tuned to a frequency f for driving its associated said motor in one direction and the other of said pair of detectors is tuned to an offsetting frequency $f-\Delta f$ for driving said motor in the other direction.

9. The system of claim 8 wherein each of said receivers further includes an "H" bridge for driving its associated said motor under the control of said pair of detectors.

10. The system of claim 1 wherein said power supply unit further includes means for causing said power supply unit rapidly to cease the further generation of said propulsion power to said common power line in case of a short circuit or overload occurring in the system.

11. The system of claim 10 wherein said means is a high speed, latching electronic circuit breaker comprising a pair of transistors connected in a commonemitter configuration, with one of said pair of transitors being normally "on" and the other being normally "off", the base of the normally "off" transistor being coupled to the collector of the normally "on" transistor, wherein a short circuit or overload condition occurring in the system causes said normally "off" transistor to be turned "on" and said normally "on" transitor to be turned "off", causing also thereby to couple a signal from said collector of said normally "on" transistor to said base of said normally "off" transistor, which said signal latches said normally "off" transistor into its said conducting state even after said short circuit or said overload condition is removed from the system.

12. The system of claim 11 wherein said means is resettable by each of said plurality of means for generating said plurality of modulated selected frequencies which is parallel coupled to said common signal transmission cable.

13. The system of claim 1 wherein each of said plurality of receivers converts said respective modulated selected frequency to which it is tuned to a modulated propulsion power for driving its said associated motor.

14. The system of claim 1 wherein said plurality of modulated selected frequencies are duty cycle modulated.

15. The system of claim 13 wherein said modulated propulsion power is duty cycle modulated.

* * * * *